US009871288B2

(12) United States Patent
Dykhouse

(10) Patent No.: US 9,871,288 B2
(45) **Date of Patent: *Jan. 16, 2018**

(54) VEHICLE DOOR HANDLE ASSEMBLY WITH ANTENNA CIRCUIT

(71) Applicant: MAGNA MIRRORS OF AMERICA, INC., Holland, MI (US)

(72) Inventor: Robert J. Dykhouse, Byron Center, MI (US)

(73) Assignee: MAGNA MIRRORS OF AMERICA, INC., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/338,780

(22) Filed: Oct. 31, 2016

(65) Prior Publication Data

US 2017/0047648 A1 Feb. 16, 2017

Related U.S. Application Data

(63) Continuation of application No. 14/297,662, filed on Jun. 6, 2014, now Pat. No. 9,484,626.

(60) Provisional application No. 61/833,078, filed on Jun. 10, 2013.

(51) Int. Cl.
*H01Q 1/32* (2006.01)
*H01Q 1/36* (2006.01)

(52) U.S. Cl.
CPC ..... *H01Q 1/3241* (2013.01); *H01Q 1/3283* (2013.01); *H01Q 1/36* (2013.01)

(58) Field of Classification Search
CPC ..... H01Q 1/3241; H01Q 1/3283; H01Q 1/36; H01Q 1/3208
See application file for complete search history.

(56) References Cited

U.S. PATENT DOCUMENTS

| | | | |
|---|---|---|---|
| 4,760,394 | A | 7/1988 | Takeuchi et al. |
| 5,233,362 | A | 8/1993 | Villaseca |
| 5,844,470 | A | 12/1998 | Gernault et al. |
| 5,999,134 | A | 12/1999 | Dishart |
| 6,291,905 | B1 | 9/2001 | Drummond et al. |
| 6,304,168 | B1 | 10/2001 | Ohta et al. |
| 6,349,450 | B1 | 2/2002 | Koops et al. |
| 6,396,408 | B2 | 5/2002 | Drummond et al. |
| 6,477,464 | B2 | 11/2002 | McCarthy et al. |
| 6,509,878 | B1 | 1/2003 | Tornatta, Jr. |
| 6,550,103 | B2 | 4/2003 | Koops et al. |

(Continued)

*Primary Examiner* — Tho G Phan

(74) *Attorney, Agent, or Firm* — Gardner, Linn, Burkhart & Flory, LLP

(57) ABSTRACT

A vehicular door handle system includes a door handle assembly for a door of a vehicle. The door handle assembly includes a door handle portion that is graspable by a user to open the vehicle door. The door handle assembly includes an antenna circuit for a passive entry system of the vehicle. The antenna circuit includes at least an inductor in series electrical connection with a capacitor. The antenna circuit includes a resistor in series electrical connection with the inductor of the antenna circuit and the capacitor of the antenna circuit. The series electrical connection includes one of (i) the resistor being disposed between the inductor and the capacitor of the antenna circuit and (ii) the resistor not being disposed between the inductor and the capacitor of the antenna circuit. The resistor functions to reduce the Q factor of the antenna circuit.

20 Claims, 3 Drawing Sheets

(56) References Cited

U.S. PATENT DOCUMENTS

| | | | | |
|---|---|---|---|---|
| 6,556,125 | B1 | 4/2003 | Rohrl | |
| 6,577,228 | B1 | 6/2003 | Tsuchida et al. | |
| 6,621,178 | B2 | 9/2003 | Morillon | |
| 6,669,267 | B1 | 12/2003 | Lynam et al. | |
| 6,700,476 | B1 | 3/2004 | Okada et al. | |
| 6,795,032 | B2 | 9/2004 | Leda et al. | |
| 6,907,643 | B2 | 6/2005 | Koops et al. | |
| 6,977,619 | B2 | 12/2005 | March et al. | |
| 7,407,203 | B2 | 8/2008 | Huizenga et al. | |
| 8,333,492 | B2 | 12/2012 | Dingman et al. | |
| 8,786,401 | B2 | 7/2014 | Sobecki et al. | |
| 8,801,245 | B2 | 8/2014 | DeWind et al. | |
| 9,484,626 | B2 * | 11/2016 | Dykhouse | H01Q 1/3241 |
| 2002/0030591 | A1 | 3/2002 | Paranjpe | |
| 2007/0188168 | A1 * | 8/2007 | Stanley | B60R 21/0136 324/228 |
| 2008/0117111 | A1 * | 5/2008 | Ikeda | H01Q 1/1214 343/713 |
| 2010/0007463 | A1 | 1/2010 | Dingman et al. | |
| 2010/0088855 | A1 | 4/2010 | Ruse et al. | |
| 2014/0240090 | A1 | 8/2014 | Mutti | |

* cited by examiner

Antenna circuit for painted handle with no chrome plating.

VEHICLE DOOR HANDLE ASSEMBLY WITH ANTENNA CIRCUIT

CROSS REFERENCE TO RELATED APPLICATIONS

The present application is a continuation of U.S. patent application Ser. No. 14/297,662, filed Jun. 6, 2014, now U.S. Pat. No. 9,484,626, which claims the filing benefits of U.S. provisional application Ser. No. 61/833,078, filed Jun. 10, 2013, which is hereby incorporated herein by reference in its entirety.

FIELD OF THE INVENTION

The present invention relates to door handles for vehicles and, more particularly, to an exterior door handle for opening a side door of a vehicle.

BACKGROUND OF THE INVENTION

A door handle for a vehicle door typically includes a handle portion that is pivotable relative to a base portion, whereby pivotal movement of the handle portion pulls at a cable or rod to electrically trigger or move a latch mechanism to release the latch and open the door.

SUMMARY OF THE INVENTION

The present invention provides a door handle assembly for a door of a vehicle, with the door handle assembly comprising an antenna circuit for an antenna of a passive entry system of the vehicle. The antenna circuit comprises an antenna (such as antenna circuitry comprising a capacitor and induction coil and the like) and a resistor, and the resistor is selected to provide or effect a reduction of a quality factor or Q factor of the antenna circuit to a selected or appropriate reduced level. The passive entry system may comprise a passive entry passive start (PEPS) system.

The door handle assembly comprises a door handle portion that is graspable by a user to open the vehicle door. The door handle portion may comprise a non-chrome-plated door handle portion or a painted door handle portion.

Therefore, the present invention provides an antenna circuit that provides the desired or appropriate reduction in the Q factor of an antenna circuit, without having to add foil tape or the like for non-chrome-plated door handles. The antenna circuit has a selected or particular resistor that has a selected or particular resistance or range of resistance, which makes the circuit function in a desired or selected manner. The resistor may be disposed in the circuit in series or in parallel, and functions to reduce the Q factor of the circuit.

These and other objects, advantages, purposes and features of the present invention will become apparent upon review of the following specification in conjunction with the drawings.

DESCRIPTION OF THE PREFERRED EMBODIMENTS

Figure 1:
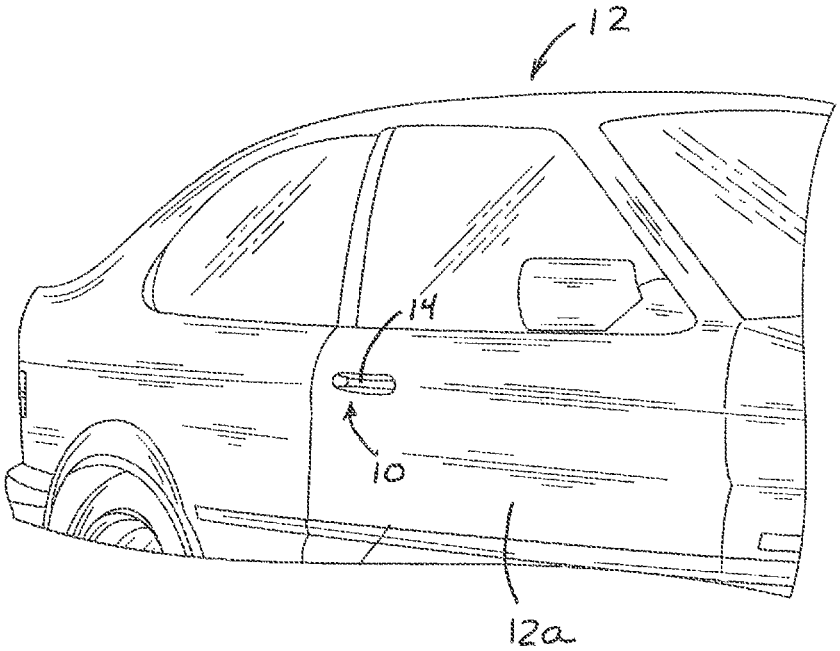
FIG. 1 is a perspective view of a vehicle with a door handle assembly of the present invention.

Referring now to the drawings and the illustrative embodiments depicted therein, a vehicle door handle assembly 10 is mountable to a door 12*a* of a vehicle 12 and operable to release a latch mechanism (not shown) of the door 12*a* to open the vehicle door (FIG. 1). Vehicle door handle assembly 10 includes a handle portion 14 that is disposed at the door and that is fixedly mounted at the door or to a bracket mounted to the door.

Door handle assembly 10 may comprise any suitable type of door handle assembly, and may include or incorporate aspects of the door handle assemblies described in U.S. Pat. Nos. 6,349,450; 6,550,103; 6,907,643; 7,407,203 and/or 8,333,492, and/or U.S. patent application Ser. No. 12/499,183, filed Jul. 8, 2009 and published Jan. 14, 2010 as U.S. Publication No. US-2010-0007463; Ser. No. 12/577,272, filed Oct. 12, 2009 and published Apr. 15, 2010 as U.S. Publication No. US-2010-0088855; Ser. No. 12/976,594, filed Dec. 22, 2010, now U.S. Pat. No. 8,786,401, and/or Ser. No. 13/674,458, filed Nov. 12, 2012, now U.S. Pat. No. 8,801,245, which are hereby incorporated herein by reference in their entireties. Although shown in FIGS. 1-6 as a strap type handle, the handle assembly may comprise any suitable type of vehicle door handle assembly, such as a paddle type vehicle door handle assembly (having a paddle or the like that may be pulled at to open the vehicle door) or other type of vehicle door handle assembly, while remaining within the spirit and scope of the present invention.

The door handle assembly includes a Passive Entry Passive Start (PEPS) antenna (such as an antenna that is installed in the door handle construction). Such an antenna must meet a quality value or factor or Q value or factor specification to function properly with the PEPS system. The quality value or factor or Q value or factor is a dimensionless parameter that is the quotient between the stored energy and radiated energy of the antenna circuit.

Figure 2:
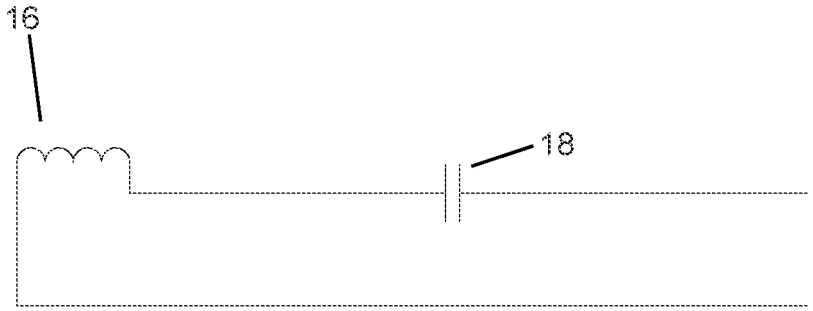
PRIOR ART FIG. 2
FIG. 2 is a schematic of a typical door handle antenna circuit for a chrome plated door handle, with the chrome plating of the door handle reducing the Q factor of the circuit to a specified or desired value or range.
Figure 3:
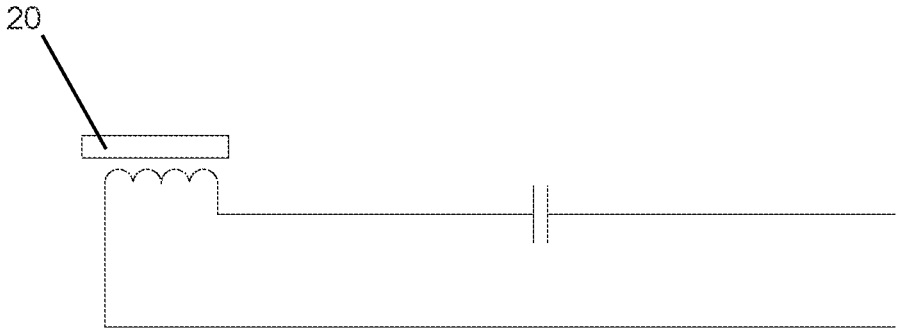
PRIOR ART FIG. 3
FIG. 3 is a schematic of a typical door handle antenna circuit for a painted door handle, with a strip of foil tape added to the circuit to reduce the Q factor of the circuit to a specified or desired value or range.

When the antenna (such as an antenna circuit comprising an induction coil 16 and a capacitor 18 and other associated circuitry) is installed in a metal decorated door handle, such as a chrome plated door handle (where such chrome plating may be desired to provide the desired appearance of the door handle and vehicle, depending on the particular application), such as along or behind the chrome plated portion of the handle assembly, such as along or behind a chrome plated handle portion or grasping portion of the door handle assembly, such as shown in FIG. 2, the metallic decorating or chrome plating (by reason of its being metallic and hence electrically conducting/EMF shielding) reduces the Q factor of the antenna circuit to the specified range. However, when the antenna is installed in a painted handle (with no chrome plating or metallic plating and hence non-electrically conducting and thus not interfering with electromagnetic transmission therethrough), such as along or behind the painted portion of the handle assembly, such as along or behind a painted handle portion or grasping portion of the door handle assembly, such as shown in FIG. 3, there is no chrome to reduce the Q factor. In order to address this issue, some door handle suppliers have added a piece of foil tape 20 to the antenna to simulate the metal or chrome plating.

The present invention provides a simpler and less costly way to correct the quality factor or Q factor (the effect of electrical resistance in the circuit or system) of the antenna circuit of a painted handle by adding a resistor 22 to the circuit board that is used to mount the capacitor that is part of the antenna circuit. The use of such a resistor avoids the need for use of the foil tape at the antenna. Adding the resistor adds energy lost to the circuit that is usually added by the chrome plating of chrome-plated door handles or that is usually added by a foil tape added at the circuit for painted door handles. The resistance value of the resistor is determined by the desired or appropriate lost energy.

Figure 4:
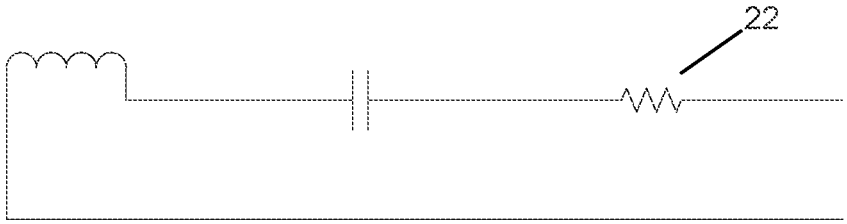
FIG. 4 is a schematic of a door handle antenna circuit of the present invention, with a resistor added to reduce the Q factor of the circuit to a specified or desired value or range.
Figure 5:
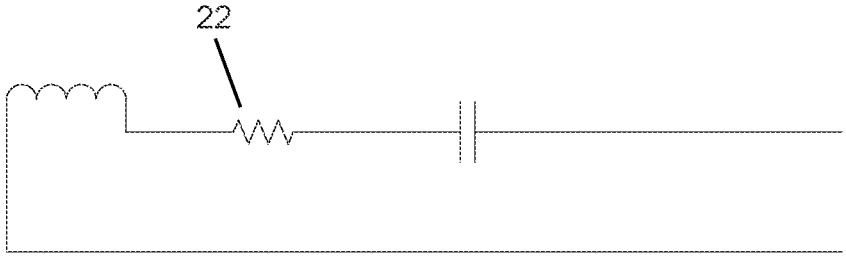
FIG. 5 is a schematic of another door handle antenna circuit of the present invention, with a resistor added to reduce the Q factor of the circuit to a specified or desired value or range.
Figure 6:
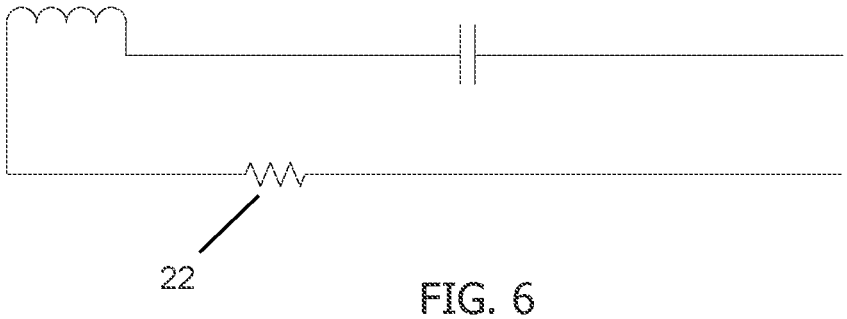
FIG. 6 is a schematic of a door handle antenna circuit of the present invention, with a resistor added to reduce the Q factor of the circuit to a specified or desired value or range.

As shown in FIGS. 4-6, a resistor 22 is added to the circuit (such as at any suitable location with respect to the induction coil and the capacitor of the circuit) to reduce the quality factor or Q factor of the circuit to the specified or desired value or range. For example, a resistor can be added to a series resonant circuit that is used for a door handle antenna. Alternatively, a resistor may be added to a parallel resonant circuit that is used for a door handle antenna. The antenna may be disposed at or near or behind the painted portion of the door handle assembly, such as a painted handle portion or grasping portion of the door handle assembly.

The resistor is selected to provide the desired or appropriate effect on the circuit so that the circuit functions in a similar manner as it would if it was disposed in a chrome-plated door handle and/or if it had a metallic or foil tape attached at the antenna. For example, an antenna circuit may initially have a resistance of approximately 5 ohms and a Q factor of approximately 120, whereby the addition of a 15 ohm resistor to the antenna circuit may reduce the Q factor to approximately 30. Thus, for example, the addition of a resistor to an antenna circuit may reduce the Q factor of the circuit to at least about 50 percent, and preferably to about 25 percent, of the initial (no resistor) Q factor. The resistor and antenna circuit of the present invention provides a more robust solution over the prior art means as the present invention limits or reduces or substantially avoids issues with the adhesive on the foil tape, which can degrade and allow the tape to move and become ineffective over the lifetime of the door handle assembly and antenna on vehicles on the roads and exposed to extreme environmental conditions. Also, the use of the resistor of the present invention provides more consistent and repeatable results and avoids issues that may arise from improper placement of the foil tape (proper placement of the tape is necessary to achieve repeatable results in prior systems).

The door handle assembly is thus operable to open the vehicle door when a user grasps the door handle portion at the side of the vehicle door. The door handle assembly is also operable in conjunction with a passive keyless entry or other sensing system that is operable to determine whether or not the person at the vehicle door is authorized for entry into the vehicle, and may only open the vehicle door when that system recognizes the user or key fob or transmitting device associated with the owner or authorized user of the vehicle. Optionally, the door handle assembly may be associated with or in communication with a door zone module, such as by utilizing aspects of the vehicle door systems described in U.S. patent application Ser. No. 12/499,183, filed Jul. 8, 2009 and published Jan. 14, 2010 as U.S. Publication No. US-2010-0007463, which is hereby incorporated herein by reference in its entirety.

Optionally, the door handle assembly may include a light module or lighting element, such as for illuminating the door handle portion or the inner portion of the door handle portion, so that the user can readily see and discern the door handle when approaching the vehicle in low lighting conditions. The lighting element may comprise a strip light or pocket light or the like, and the door handle assembly may include a ground illumination light and/or other light or lighting element, such as a projection light or the like, such as by utilizing aspects of the door handle assemblies and lighting systems described in U.S. Pat. Nos. 5,371,659; 5,497,305; 5,669,699; 5,823,654; 6,349,450 and/or 6,550,103, and/or U.S. patent application Ser. No. 12/499,183, filed Jul. 8, 2009 and published Jan. 14, 2010 as U.S. Publication No. US-2010-0007463; Ser. No. 12/577,272, filed Oct. 12, 2009 and published Apr. 15, 2010 as U.S. Publication No. US-2010-0088855; Ser. No. 12/976,594, filed Dec. 22, 2010, now U.S. Pat. No. 8,786,401, and/or Ser. No. 13/674,458, filed Nov. 12, 2012, now U.S. Pat. No. 8,801,245, which are hereby incorporated herein by reference in their entireties.

Optionally, the door handle assembly may include or may be associated with an antenna for receiving signals from or communicating with a remote device. For example, the antenna (such as, for example, an antenna of the types described in U.S. Pat. No. 6,977,619, which is hereby incorporated herein by reference in its entirety) may communicate a signal to the door locking system via a wire connection or the like, or wirelessly, such as via a radio frequency signal or via an infrared signal or via other wireless signaling means. Such connections can include cables, wires, fiber optic cables or the like. The communication to the locking system may be via a vehicle bus or multiplex system, such as a LIN (Local Interconnect Network) or CAN (Car or Controlled Area Network) system, such as described in U.S. Pat. Nos. 6,291,905; 6,396,408 and/or 6,477,464, which are all hereby incorporated herein by reference in their entireties. The vehicle door may then be unlocked and/or the illumination source or sources may be activated as a person carrying a remote signaling device approaches the door handle. Optionally, other systems may be activated in response to the remote signaling device, such as vehicle lighting systems, such as interior lights, security lights or the like (such as security lights of the types disclosed in U.S. Pat. Nos. 6,280,069; 6,276,821; 6,176,602; 6,152,590; 6,149,287; 6,139,172; 6,086,229; 5,938,321; 5,671,996; 5,497,305; 6,416,208 and/or 6,568,839, all of which are hereby incorporated herein by reference in their entireties), or the vehicle ignition, or any other desired system, while remaining within the spirit and scope of the present invention. The door handle and/or illumination module may be in communication with other systems and/or controls of the vehicle door and/or vehicle, such as by utilizing aspects of the door systems described in U.S. patent application Ser. No. 12/499,183, filed Jul. 8, 2009 and published Jan. 14, 2010 as U.S. Publication No. US-2010-0007463, which is hereby incorporated herein by reference in its entirety.

Optionally, the door handle assembly of the present invention may include a soft touch handle portion, such as utilizing the principles described in U.S. Pat. Nos. 6,349,450; 6,550,103 and 6,907,643, which are hereby incorporated herein by reference in their entireties. Optionally, the door handle assembly may include an antenna or the like, such as for sensing or transmitting signals, such as described in U.S. Pat. No. 6,977,619, which is hereby incorporated herein by reference in its entirety.

Changes and modifications to the specifically described embodiments may be carried out without departing from the principles of the present invention, which is intended to be limited only by the scope of the appended claims as interpreted according to the principles of patent law.

The invention claimed is:

1. A vehicular door handle system, said door handle system comprising:

a door handle assembly for a door of a vehicle, said door handle assembly configured to mount at a handle region of the vehicle door;

said door handle assembly comprising a door handle portion that is graspable by a user to open the vehicle door;

said door handle assembly comprising an antenna circuit for a passive entry system of the vehicle, said antenna circuit comprising at least an inductor in series electrical connection with a capacitor;

wherein said antenna circuit comprises a resistor in series electrical connection with said inductor of said antenna circuit and said capacitor of said antenna circuit;

wherein said series electrical connection comprises one of (i) said resistor being disposed between said inductor and said capacitor of said antenna circuit and (ii) said resistor not being disposed between said inductor and said capacitor of said antenna circuit; and wherein said resistor functions to reduce the Q factor of said antenna circuit.

2. The vehicular door handle system of claim 1, wherein the passive entry system comprises a passive entry passive start system.

3. The vehicular door handle system of claim 1, wherein said door handle portion comprises a non-metallic door handle portion.

4. The vehicular door handle system of claim 3, wherein said door handle portion comprises a painted door handle portion.

5. The vehicular door handle system of claim 1, wherein said resistor functions to reduce the Q factor of said antenna circuit by at least 50 percent.

6. The vehicular door handle system of claim 1, wherein said resistor functions to reduce the Q factor of said antenna circuit by 75 percent.

7. The vehicular door handle system of claim 1, wherein said antenna circuit is disposed within said door handle portion that is graspable by a user to open the vehicle door.

8. The vehicular door handle system of claim 7, wherein said door handle assembly includes a lighting element operable for illuminating said door handle portion.

9. The vehicular door handle system of claim 7, wherein said capacitor of said antenna circuit is disposed on a circuit board and wherein said resistor is disposed on said circuit board.

10. A vehicular door handle system, said door handle system comprising:

a door handle assembly for a door of a vehicle, said door handle assembly configured to mount at a handle region of the vehicle door;

said door handle assembly comprising a door handle portion that is graspable by a user to open the vehicle door;

said door handle assembly comprising an antenna circuit for a passive entry system of the vehicle, said antenna circuit comprising at least an inductor in series electrical connection with a capacitor;

wherein said antenna circuit comprises a resistor in series electrical connection with said inductor of said antenna circuit and said capacitor of said antenna circuit;

wherein said series electrical connection comprises said resistor not being disposed between said inductor and said capacitor of said antenna circuit;

wherein said resistor functions to reduce the Q factor of said antenna circuit;

wherein said door handle portion comprises a non-metallic door handle portion; and wherein said door handle portion comprises a painted door handle portion.

11. The vehicular door handle system of claim 10, wherein said antenna circuit is disposed within said door handle portion that is graspable by a user to open the vehicle door.

12. The vehicular door handle system of claim 11, wherein said door handle assembly includes a lighting element operable for illuminating said door handle portion.

13. The vehicular door handle system of claim 10, wherein said capacitor of said antenna circuit is disposed on a circuit board and wherein said resistor is disposed on said circuit board.

14. The vehicular door handle system of claim 13, wherein said resistor functions to reduce the Q factor of said antenna circuit by at least 50 percent.

15. The vehicular door handle system of claim 13, wherein said resistor functions to reduce the Q factor of said antenna circuit by 75 percent.

16. A vehicular door handle system, said door handle system comprising:

a door handle assembly for a door of a vehicle, said door handle assembly configured to mount at a handle region of the vehicle door;

said door handle assembly comprising a door handle portion that is graspable by a user to open the vehicle door;

said door handle assembly comprising an antenna circuit for a passive entry system of the vehicle, said antenna circuit comprising at least an inductor in series electrical connection with a capacitor;

wherein said antenna circuit comprises a resistor in parallel electrical connection with at least one of said inductor of said antenna circuit and said capacitor of said antenna circuit;

wherein said resistor functions to reduce the Q factor of said antenna circuit;

wherein said door handle portion comprises a non-metallic door handle portion;

wherein said door handle portion comprises a painted door handle portion; and wherein said antenna circuit is disposed within said door handle portion that is graspable by a user to open the vehicle door.

17. The vehicular door handle system of claim 16, wherein said door handle assembly includes a lighting element operable for illuminating said door handle portion.

18. The vehicular door handle system of claim 17, wherein said capacitor of said antenna circuit is disposed on a circuit board and wherein said resistor is disposed on said circuit board.

19. The vehicular door handle system of claim 18, wherein said resistor functions to reduce the Q factor of said antenna circuit by at least 50 percent.

20. The vehicular door handle system of claim 16, wherein said resistor functions to reduce the Q factor of said antenna circuit by 75 percent.

* * * * *